US010030815B2

(12) United States Patent
Fuchs et al.

(10) Patent No.: US 10,030,815 B2
(45) Date of Patent: Jul. 24, 2018

(54) METHOD AND APPARATUS FOR RELIQUEFYING NATURAL GAS

(71) Applicant: CRYOSTAR SAS, Hessingue (FR)

(72) Inventors: Vincent Fuchs, Brinckheim (FR); Mathias Ragot, Sierentz (FR)

(73) Assignee: CRYOSTAR SAS, Hesingue (FR)

( * ) Notice: Subject to any disclaimer, the term of this patent is extended or adjusted under 35 U.S.C. 154(b) by 0 days.

(21) Appl. No.: 14/652,859

(22) PCT Filed: Dec. 17, 2013

(86) PCT No.: PCT/EP2013/076920
§ 371 (c)(1),
(2) Date: Jun. 17, 2015

(87) PCT Pub. No.: WO2014/095877
PCT Pub. Date: Jun. 26, 2014

(65) Prior Publication Data

US 2015/0330574 A1 Nov. 19, 2015

(30) Foreign Application Priority Data

Dec. 20, 2012 (EP) ..... 12352005

(51) Int. Cl.
*F25J 1/00* (2006.01)
*F17C 9/02* (2006.01)
(Continued)

(52) U.S. Cl.
CPC ..... *F17C 9/02* (2013.01); *F17C 13/00* (2013.01); *F25J 1/005* (2013.01); *F25J 1/0025* (2013.01);
(Continued)

(58) Field of Classification Search
CPC .... F25J 1/0025; F25J 2210/90; F25J 2245/90; F17C 2265/032; F17C 2265/033;
(Continued)

(56) References Cited

U.S. PATENT DOCUMENTS 2,959,020 A * 11/1960 Knapp ..... F25J 1/0007 62/47.1
4,054,433 A * 10/1977 Buffiere ..... F17C 9/04 62/48.1
(Continued)

*Primary Examiner* — Brian King
(74) *Attorney, Agent, or Firm* — Joshua L. Cohen

(57) ABSTRACT

Natural gas boiling off from LNG storage tanks located on board a sea-going vessel, is compressed in a plural stage compressor. At least part of the flow of compressed natural gas is sent to a liquefier operating on a Brayton cycle in order to be reliquefied. The temperature of the compressed natural gas from the final stage is reduced to below 0° C. by passage through a heat exchanger. The first compression stage is operated as a cold compressor and the resulting cold compressed natural gas is employed in the heat exchanger to effect the necessary cooling of the flow from the compression stage. Downstream of its passage through the heat exchanger the cold compressed natural gas flows through the remaining stages of the compressor. If desired, a part of the compressed natural gas may be supplied to the engines of the sea-going vessel as a fuel.

9 Claims, 6 Drawing Sheets

Figure 1:
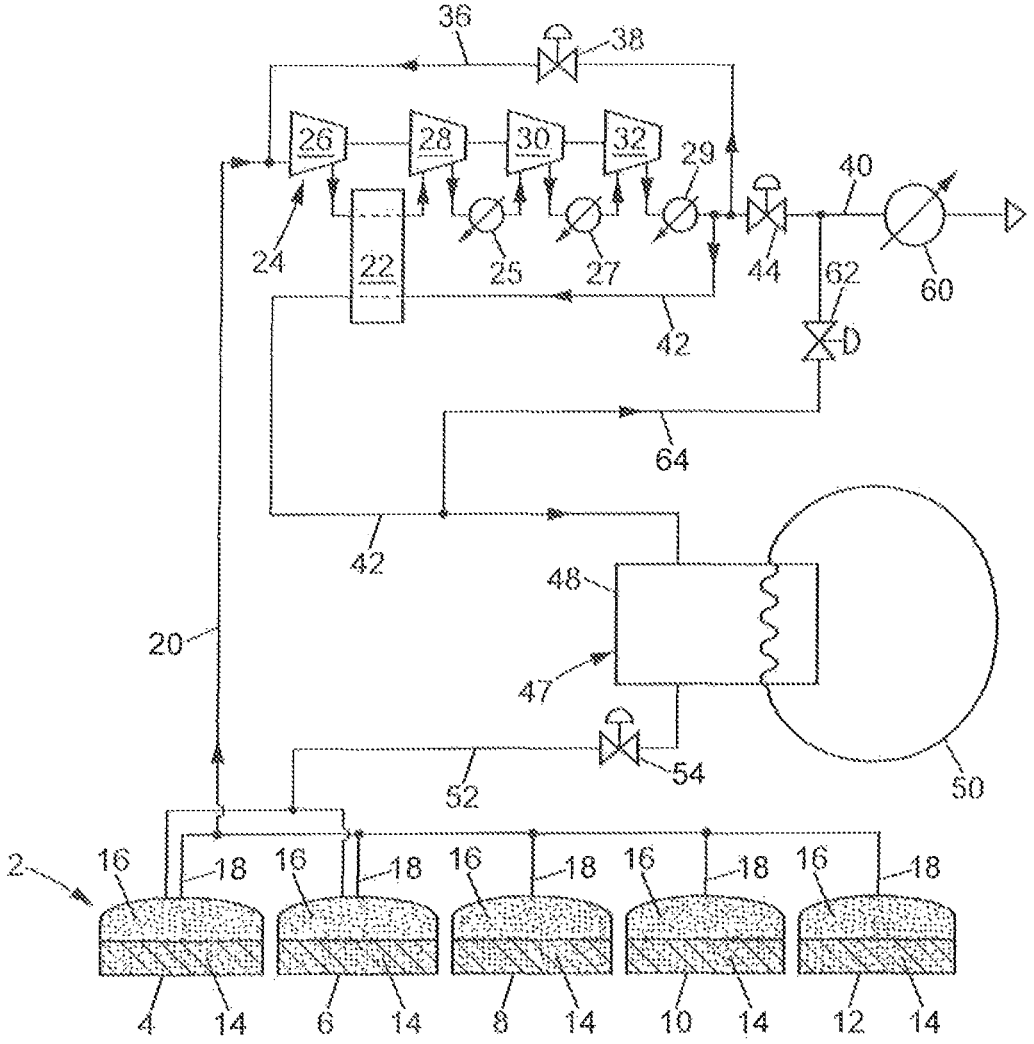

(51) Int. Cl.
*F25J 1/02* (2006.01)
*F17C 13/00* (2006.01)

(52) U.S. Cl.
CPC ..... *F25J 1/0045* (2013.01); *F25J 1/0072* (2013.01); *F25J 1/023* (2013.01); *F25J 1/0204* (2013.01); *F25J 1/0221* (2013.01); *F25J 1/0245* (2013.01); *F25J 1/0265* (2013.01); *F25J 1/0277* (2013.01); *F25J 1/0288* (2013.01); *F17C 2203/011* (2013.01); *F17C 2205/0146* (2013.01); *F17C 2221/033* (2013.01); *F17C 2223/0161* (2013.01); *F17C 2265/034* (2013.01); *F17C 2265/066* (2013.01); *F17C 2270/0105* (2013.01); *F25J 2210/62* (2013.01); *F25J 2230/08* (2013.01); *F25J 2230/30* (2013.01); *F25J 2235/60* (2013.01); *F25J 2270/02* (2013.01)

(58) Field of Classification Search
CPC ..... F17C 2265/034; F17C 2223/0161; F17C 2270/0118; F17C 9/02; F17C 9/04; F17C 2265/066
See application file for complete search history.

(56) References Cited

U.S. PATENT DOCUMENTS

| | | | | |
|---|---|---|---|---|
| 2007/0251266 | A1 | 11/2007 | Nobumi et al. | |
| 2009/0100844 | A1 | 4/2009 | Rumelhoff | |
| 2010/0000253 | A1* | 1/2010 | Fuchs ..... | F25J 1/0025 62/613 |
| 2011/0056238 | A1 | 3/2011 | Mak | |

* cited by examiner

METHOD AND APPARATUS FOR RELIQUEFYING NATURAL GAS

This invention relates to a method of and apparatus for reliquefying natural gas.

In particular, it relates to a method for reliquefying natural gas that boils off from liquefied natural gas (LNG) storage tanks typically on board a ship or other sea-going vessel.

US patent applications 2007/0256450 A, 2009/0158773 A and 2009/0158774 all disclose methods of liquefying natural gas boiling off from a storage tank ("boil off" gas) in which refrigeration is recovered from the boil off gas upstream of its compression. The compressed boil off gas is reliquefied downstream of its compression. The compressed boil off is pre-cooled in a heat exchanger through which the same gas passes upstream of its compression in such a way the temperature of the compressed boil off gas can be reduced to well below ambient temperature and thus the amount of refrigeration that needs to be provided in the liquefier in order to liquefy the natural gas is reduced.

The above described arrangement does, however, have a significant disadvantage. The liquefied natural gas storage tanks from which the boil off gases evolved are designed to operate at an ullage space pressure only a little above atmospheric pressure. The provision of a heat exchanger upstream of the boil off gas compressor can cause the pressure to fall below atmospheric pressure with the consequence that there is a significant risk of air being drawn into the apparatus. The presence of such air can cause an explosion risk, particularly if all the boil off gas is reliquefied and returned to the storage tank. Even if the heat exchanger were to be oversized, there would still be a significant pressure drop which would cause operational difficulties in maintaining an adequate pressure throughout the system.

According to the present invention there is provided a method of recovering boil off gas evolved from at least one storage vessel holding liquefied natural gas (LNG), comprising cold compressing a flow of the boil off gas in a first compression stage, warming by heat exchange the flow of the cold compressed boil off gas, further compressing the warmed flow of the cold compressed boil off gas, and employing at least part of the further compressed flow of the boil off gas to warm in the said heat exchange the flow of the cold compressed boil off gas and thereby reduce the temperature of the said part of the further compressed boil off gas, and reliquefying least a portion of the said part of the further compressed flow of the boil off gas that is subjected to the temperature reduction.

The invention also provides apparatus for recovering boil off gas from at least one storage vessel holding liquefied natural gas, comprising a first cold compression stage communicating with the said storage vessel; a plurality of further compression stages in series for further compressing the boil off gas downstream of the cold compression stage, and a liquefier downstream of the further compression stages for reliquefying the boil off gas, wherein there is a heat exchanger which has at least one heat exchange passage having an inlet communicating with the outlet of the first cold compression stage and an outlet communicating with the further compression stages and at least one second heat exchange passage in heat exchange relationship with the said first heat exchange passage, the said second heat exchange passage having an inlet in communication with the further compression stages and an outlet in communication with the liquefier.

The position of the heat exchanger avoids pressure drop upstream of the compression stages. The operation of the first compression stage as a cold compression stage makes it possible for all or that part of the further compressed boil off gas which is liquefied to be pre-cooled to below 0° C. upstream of its liquefaction. There is therefore no need to include any heat exchanger (or other means) upstream of the first compression stage in order to warm the boiled off natural gas, which heat exchanger would cause an undesirable pressure drop.

In general, the method and apparatus according to the invention is able to be adapted to meet a number of different needs for the supply of natural gas and a wide range of different supply pressures.

The method and apparatus according to the invention are particularly, but not exclusively intended for use onboard a ship or other sea-going vessel. If the sea-going vessel is a transporter of LNG from a site of production to a site of use, then essentially all of the boil off gas may be reliquefied. In some instances, however, some of the natural gas is used on hoard the sea-going vessel to generate power, for example, for use in the propulsion of the sea-going vessel itself. In this instance, only some of the further compressed boil off gas need be reliquefied and the rest of it supplied for the purposes of the power generation.

In yet further examples, natural gas for power generation use is taken from the said storage vessel and pumped to a suitable pressure. In such examples, all the boil off gas may be reliquefied, some of it instead of being returned to the said storage vessel may be taken for power generation. Further, in these examples, refrigeration may be recovered from the pumped natural gas and employed to provide further temperature reduction to the flow of the further compressed boil-off gas to be liquefied.

The reliquefication of the part of the further compressed flow of the natural gas that is subjected to temperature reduction (or of a chosen portion of this part) is preferably effected by means of a Brayton cycle. Nitrogen is preferably the working fluid in the Brayton cycle.

Figure 3:
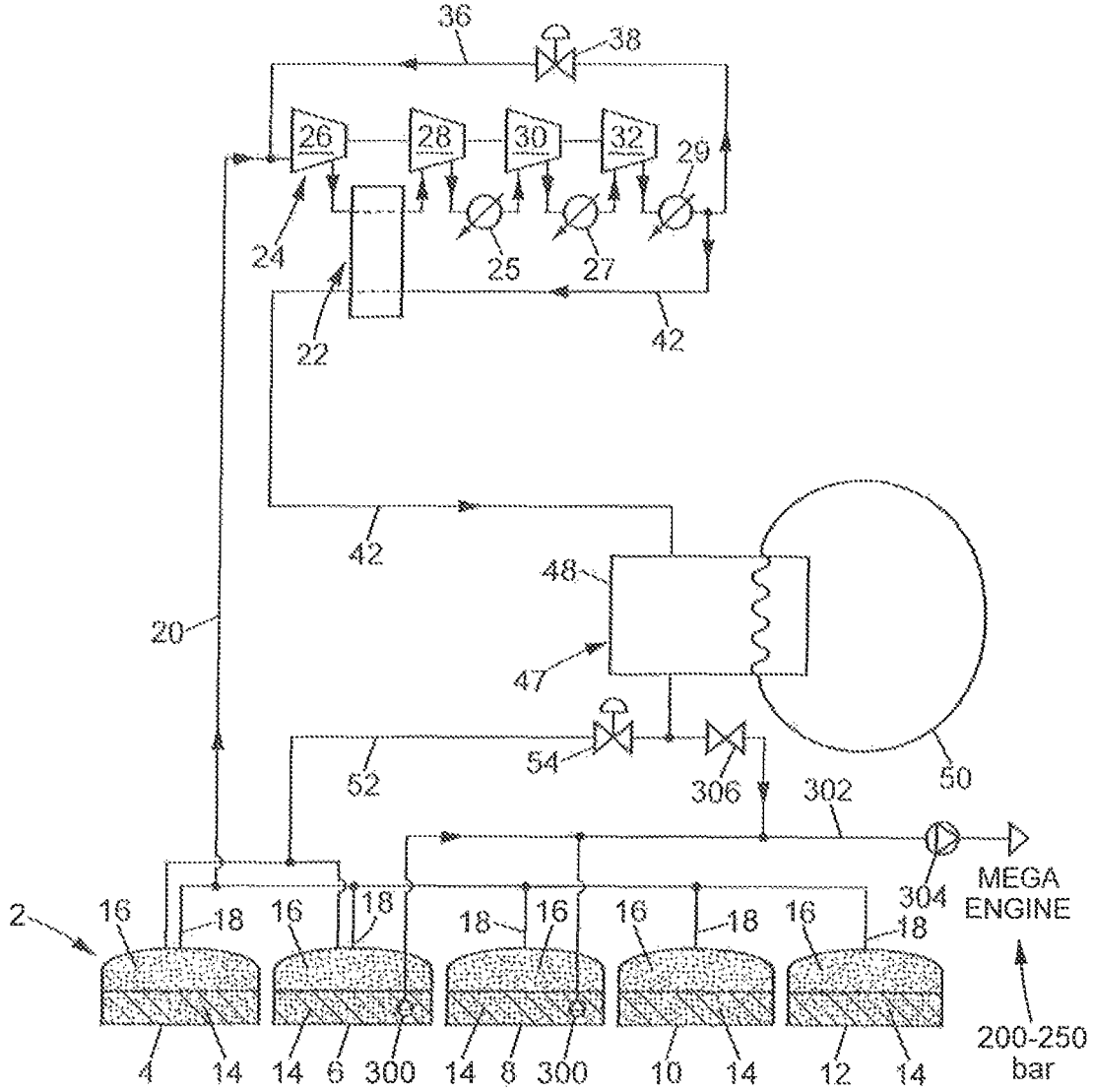
Figure 4:
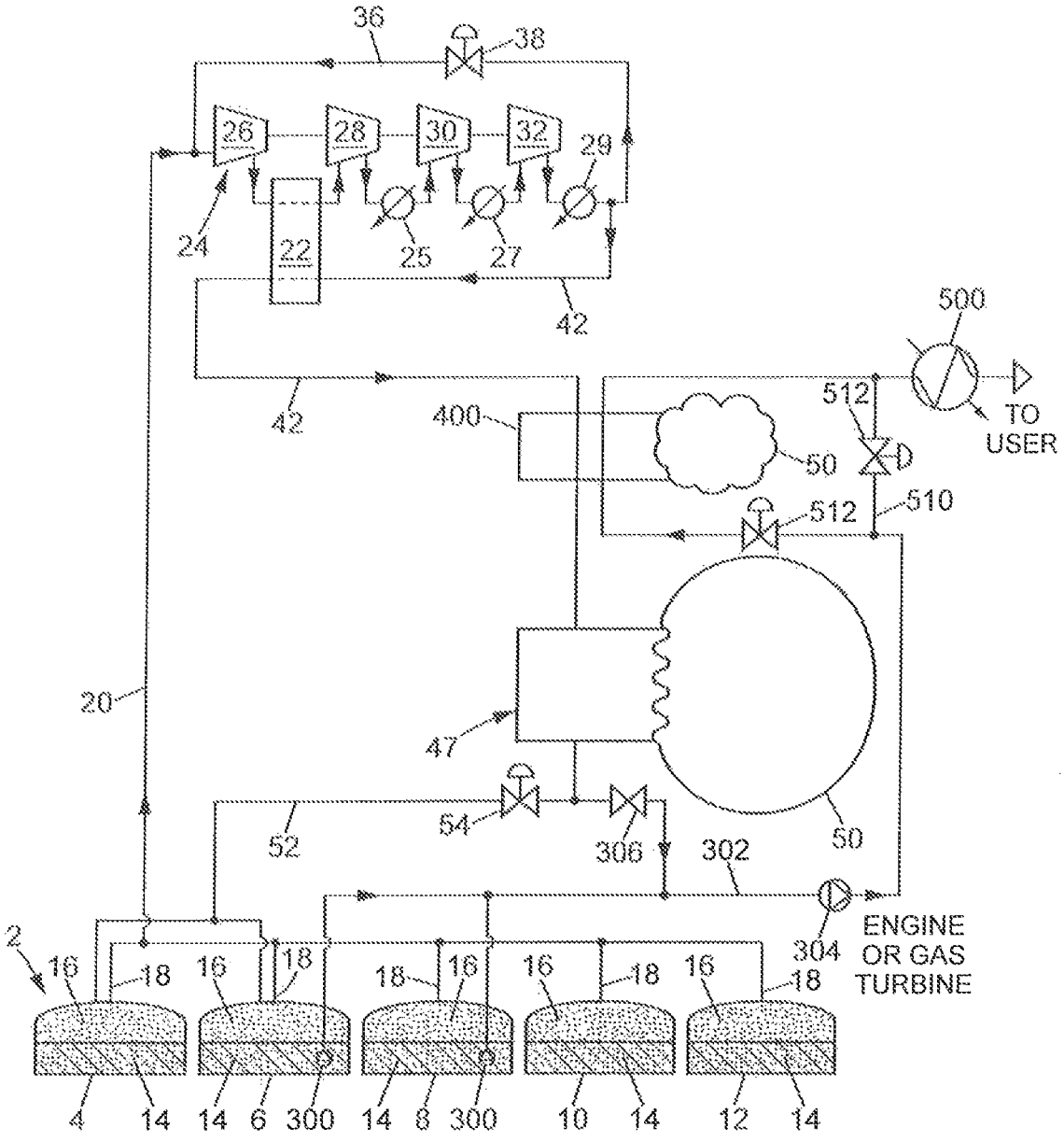
Figure 5:
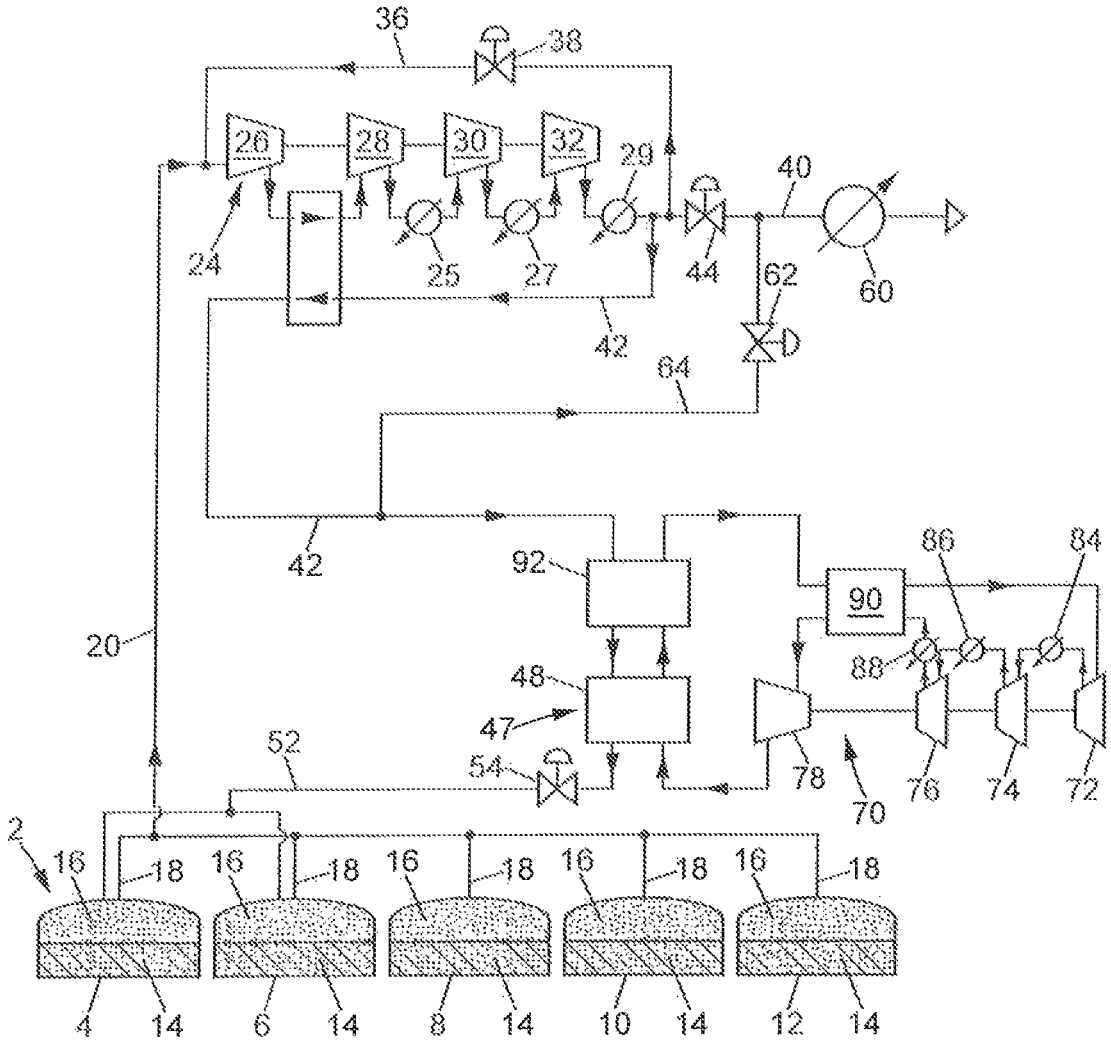
Figure 6:
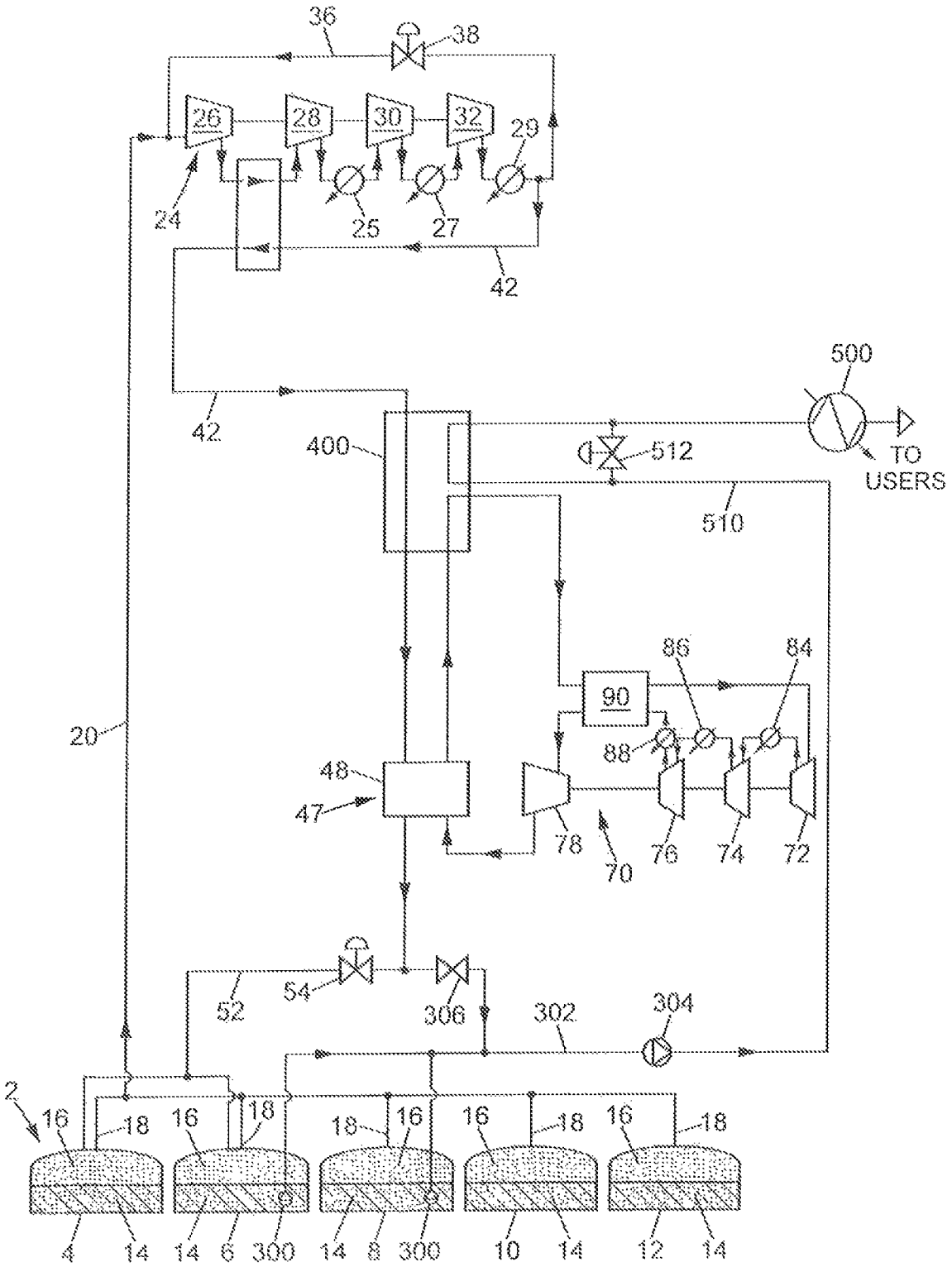

The method and apparatus according to the invention will now be described by way of example with reference to the accompanying drawings in which, FIGS. 1 to 4 are generalised, schematic flow diagrams of different natural gas supply plants according to the invention with the refrigeration cycle for the liquefier being shown only generally and FIGS. 5 and 6 are schematic flow diagrams of such plants in which the refrigeration cycle is shown in more detail.

Like parts in the Figures are indicated by the same reference numerals.

Referring, to FIG. 1, there is shown a battery 2 of LNG storage tanks or vessels. The storage tanks are located on hoard a sea-going LNG carrier. Five essentially identical storage tanks 4, 6, 8, 10 and 12 are shown in FIG. 1. Although five storage tanks are illustrated, the battery 2 may comprise any number of such tanks. Each of the LNG storage tanks 4, 6, 8, 10 and 12 is thermally insulated so as to keep down the rate at which its contents, LNG, absorbs heat from the surrounding environment. Each of the storage tanks 4, 6, 8, 10 and 12 is shown in FIG. 1 as containing a volume 14 of LNG. There is naturally an ullage space 16 in each of these tanks above the level of the liquid therein. Since natural gas boils at a temperature well below −100° C., there is continuous evaporation of the LNG from each volume 14 of the ullage space 16 thereabove. In accordance with the invention, the evaporated LNG is withdrawn from the tanks 4, 6, 8, 10 and 12 and is in normal operation liquefied at least in part. Thus, each of the tanks 4, 6, 8, 10 and 12 has an outlet 18 for the boiled-off vapour. The outlets 18 all communicate with a pipeline 20 for the boiled-off vapour.

The pipeline 20 communicates with a plural stage compressor 24. As shown in FIG. 1, the compressor 24 has four compression stages 26, 28, 30 and 32 which progressively progress the natural gas to a higher and higher pressure. It is not essential that just four such compression stages be used. The optimum number of compression stages will depend on the pressure at which the compressor 24 is required to supply the natural gas and on the variation of inlet temperature that the compressor 24 encounters in operation. In general, the higher the required supply pressure, the more compression stages that might be needed. Similarly, the higher the maximum inlet temperature, the more compression stages that might be needed.

Since the rate of boiled-off natural gas from the battery 2 of storage tanks 4, 6, 8, 10 and 12 fluctuates with variations in ambient temperature and sea-going conditions, means for compensating such variations are provided in the apparatus shown in FIG. 1. The compensation means includes the provision of inlet guide vanes (not shown) or variable diffuser vanes (not shown) for each compression stage or for some of the compression stages. In addition, there is a recycle line 36 downstream of the final compressor stage 32 and a flow control valve 38 located in this recycle line 36. The recycle line 36 provides anti-surge control for the compressor 24 with the valve 38 opening as necessary. Alternatively, each stage or pair of stages may have a separate anti-surge system.

In accordance with the invention, a first compression stage 26 is operated as a cold compression stage with an inlet temperature well below ambient temperature. On the other hand, the heat of compression in the remaining compression stages 28, 30 and 32 is sufficient to raise the temperature therein well above ambient. Accordingly, coolers 25, 27 and 29 are provided downstream of respectively, the compression stages 28, 30 and 32. Each of the coolers 25, 27 and 29 typically employs a flow of water to effect the cooling and can take the form of any conventional kind of heat exchanger. The coolers 25 and 27 are both interstate coolers, that is the cooler 25 is located intermediate the compression stages 28 and 30 and the cooler 27 is located intermediate the compression stages 30 and 32. The cooler 29 is an after cooler, being located downstream of the final compression stage 32 at a position intermediate the outlet from the compression stage 32 and the union of the recycle line 36 with a main natural gas supply pipeline 40 to which the compressor 24 supplies compressed natural gas. The compressor 24 may comprise additional stages with intercoolers, as required.

As shown in FIG. 1, some of the natural gas flows to the end of the pipeline 40, typically for supply to an engine or other machine for doing work (not shown) and the remainder of the natural gas flows to a pipeline 42 the inlet of which is located intermediate the aftercooler 29 and the union of the recycle line 36 with the main supply pipeline 40.

At least part of the compressed natural gas that is supplied to the pipeline 42 is sent to a liquefier 47. In accordance with the invention, the natural gas flowing through the pipeline 42 is pre-cooled upstream of its liquefaction. The pre-cooling, is effected in a heat exchanger 22 by countercurrent heat exchange with natural gas flowing from the first (cold compression) stage 26 of the compressor 24 to the second compression stage 28 thereof. The resulting stream of natural gas that flows out of the heat exchanger 22 along the pipeline 42 passes to the liquefier 47 in which it is liquefied. A conduit 64 branches off from the pipeline 42 and terminates in the main gas supply pipeline 40. A flow control valve 44 is positioned in the pipeline 40 upstream of its union with the conduit 64. A similar flow control valve 62 is located in the conduit 64.

In normal operation, it is desired to supply natural gas to the sea-going vessel's propulsion system (not shown) (which may include dual-fuel engines) at rate that approximates to a constant one. This rate may be set or adjusted by operation of a gas valve unit (not shown) in front of the dual-fuel engines (not shown). The valve 44 in the pipeline 40 and the valve 62 in the conduit 64 are used for changing the proportion of the pressurised natural gas passing through the heat exchanger 22 so as to adjust the boiled-off vapour temperature so as to adjust the temperatures of the streams flowing therethrough. The liquefier 47 may comprise a second heat exchanger (or array of heat exchangers 48), in which it is condensed by indirect heat exchange with a working fluid flowing a refrigeration cycle 50, preferably a Brayton cycle. The resultant condensate is typically returned to the storage tanks 4, 6, 8, 10 and 12 via a pipeline 52, in which a flow control valve 54 for adjusting the rate of the boiled-off gas to be liquefied is located.

Because dependent upon the setting of flow control valves 44 and 62, the compressed natural gas flow in the main supply pipeline 40 may have a sub-zero temperature, a heater 60 is preferably provided in the pipeline 40. The heater 60 may warm the natural gas by heat exchange with steam or other heating medium.

It is also envisaged that the invention may supply other consumers including, but not limited to 2-stroke or 4-stroke dual or tri fuel engines, gas turbines or boilers used for mechanical steam or electrical power generation. Typical pressure ranges might be 0 to 3 bara for a steam plant, 0 to 7 bara for a dual fuel 4-stroke engine, 130 to 320 bara for a dual fuel 2-stroke engine and 20 to 50 bara for a gas turbine plant.

There are a large number of options for the plant shown in FIG. 1, all exploiting the cold compression of the boiled-off natural gas in the first compression stage 26 to provide cooling for the compressed natural gas to be liquefied, the cooling being provided in the heat exchanger 27.

Figure 2:
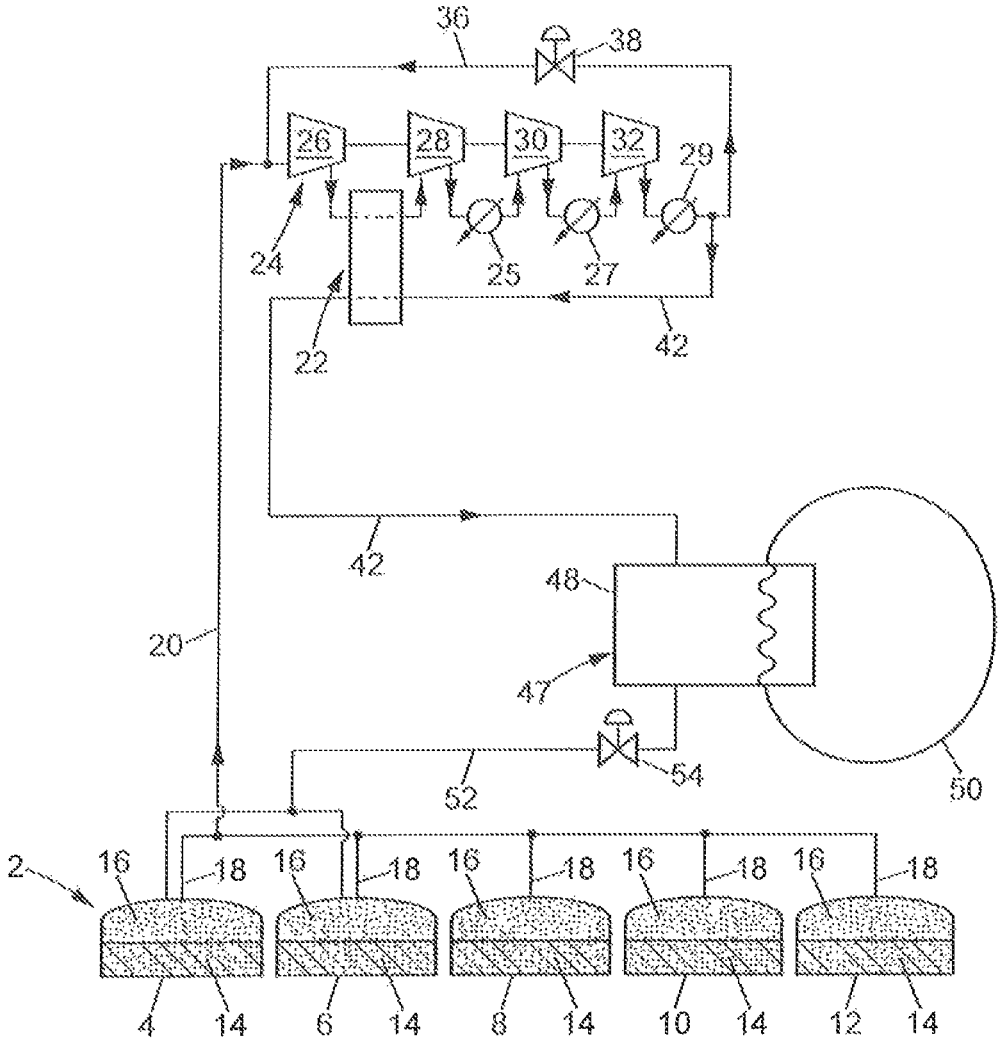

FIG. 2 shows a plant which is suitable for use when there is no demand for natural gas for power generation or the propulsion of the ship or other sea-going vessel. In such an instance the ship's engines may exclusively employ a fuel oil (for example, HFO, MDO, MGO) as their fuel. In comparison with FIG. 1, therefore, there is now no main gas supply line 40 and apart from the anti-surge flow in the line 36, all the natural gas from the compressor 24 is sent through the heat exchanger 22 and is liquefied in the liquefier 47.

In the plant shown in FIG. 3, natural gas is taken for the purposes of the ship's propulsion, but in this case is taken in liquid state from the tanks 4, 6, 8, 10 and 12. Accordingly, at least two of the tanks are provided with a submerged low pressure pump 300. Each of the pumps 300 is connected to a main LNG pipeline 302 in which a high pressure LNG pump 304 is located. If a high fuel gas inspection pressure is required by the power generating means (i.e. the ship's engine), the pump 304 can comprise mountable pumping stages and can raise the pressure to a value typically in the range of 20 to 50 bar or 200 to 300 bar. Because the natural gas for the purposes of the propulsion of the ship is taken from the battery 2, there is no need for a pipeline 40 and similarly to the arrangement shown in FIG. 2, essentially all the natural gas that is compressed in the compressor 24 is returned through the heat exchanger 22 for liquefaction in the liquefier 47. If desired, some or all of this liquid may be returned not to the tanks 4, 6, 8, 10 and 12 but instead via a flow control valve 306 to the pipeline 302 upstream of the high pressure pump 304.

FIG. 4 shows a modification to the plant illustrated in FIG. 3 which enables some of the refrigeration in the LNG used for the vessel's power production to be exploited to cool further the compressed natural gas upstream of its liquefaction in the liquefier 47. Hence, natural gas from heat exchanger 22 is sent to one or a plurality of further pre-cooling exchanger 400 located in the pipeline 42 upstream of liquefier 47. Now the pipeline 302, downstream of the high pressure pumps 304, extends through the heat exchanger 400. Pre-cooling heat exchanger 400 is refrigerated by both the refrigeration cycle 50 (or by an additional refrigeration cycle) and high pressure LNG from pump 304. As a result the high pressure LNG from the pump 304 further pre-cools the natural gas from the heat exchanger 22.

A heater 500 is provided in the pipeline 302 downstream of the heat exchanger 400. In addition, a conduit 510 is provided to enable some of the high pressure natural gas from the pump 304 to bypass the heat exchanger 400 according to the position of a flow control values 512 located in the conduits 510 and 302. The high pressure natural gas from the heater 500 may be used to supply an engine (not shown) or gas turbine (not shown) on board the ship.

There are a number of different choices for the refrigeration cycle which is used to cool the heat exchanger array 48 in the plant shown in FIGS. 1 to 4. One of these choices is illustrated in FIG. 5, which is based on a plant in which no pressurised LNG is taken from the storage vessels to supplement the boil off gas. The plant thus has a number of similarities to that shown in FIG. 1.

Referring to FIG. 5, a Brayton cycle is used for cooling the heat exchanger 48. A working fluid, preferably nitrogen, at lowest pressure in the cycle is received at the inlet to a first compression stage 72 of a compression/expansion machine 70 (sometimes referred to as "compander") having three compression stages 72, 74 and 76 in series, and downstream of the compression stage 76, a single turbo-expander 78. The compression stages 72, 74 and 76 are all operatively associated with the same drive mechanism (not shown). In operation, nitrogen working fluid flows in sequence through the compression stages 72, 74 and 76 of the compression-expansion machine 70. Intermediate stages 72 and 74 the working fluid is cooled to approximately ambient temperature in a first interstage cooler 74; and intermediate compression stages 74 and 76, the compressed nitrogen is cooled in a second interstage cooler 86. The compressed nitrogen leaving the final compression stage 76 is cooled in an aftercooler 88. Water for the coolers 84, 86 and 88 may be provided from the sea-going vessel's own clean water circuit (not shown).

Downstream of the aftercooler 88, the compressed nitrogen flows through a heat exchanger 90 in which it is further cooled by indirect heat exchange with a returning nitrogen stream. The resulting compressed, cooled, nitrogen stream flows to the turbo-expander 78 in which it is expanded with the performance of external work. The external work can be providing a part of the necessary energy needed to compress the nitrogen in the compression stages 72, 74 and 76. The expansion of the nitrogen working fluid has the effect of further reducing its temperature. As a result it is at a temperature suitable for the condensation of natural gas in a condensing heat exchanger by indirect counter-current heat exchange. The nitrogen working fluid, now heated as a result of its heat exchange with condensing natural gas vapour flows through a pre-cooling heat exchanger 92 (additional to the heat exchanger 22) in which it pre-cools the natural gas upstream to its entry into the condensing heat exchanger 48. As a result, nitrogen working fluid is further warmed. It is this nitrogen stream which forms a returning nitrogen stream for further cooling of the compressed nitrogen in the heat exchanger 90. The resulting nitrogen stream is eventually received in the first compression stage 72 of the compression-expansion machine 70 thus completing the circuit.

Referring now to FIG. 6, there is illustrated a refrigeration cycle for the plant shown in FIG. 4 in which the boil off gas is supplemented with pressurised LNG withdrawn from the LNG storage vessel. In the example of the plant shown in FIG. 6, the high pressure LNG produced in the pump 304 is kept separate from the nitrogen in the refrigeration cycle. If the high pressure LNG were to be heat exchanged with the nitrogen in the heat exchanger 400, there would be, as a result of the typical pressure difference between the two fuel streams (nitrogen being at a maximum pressure of less than 15 bar a, the LNG being at a pressure of more than 20 bar a and up to 300 bar a) a risk of natural gas into the nitrogen. By recovering independently the cold of the high pressure LNG with the compressed natural gas, there is no related safety of pollution risk since the composition of both fluids is mainly methane.

In normal operation of the plants shown in FIGS. 1 to 5, the boiled-off natural gas compressor 24 typically has an outlet pressure in the range 6 to 8 bars. When the battery 2 of storage tanks 4, 6, 8, 10 and 12 is laden with, for example, LNG, e.g. on an outward voyage from a site of natural gas extraction to a site of LNG distribution, the compressed boiled-off natural gas is supplied along the pipeline 40 to the propulsion system of the sea-going vessel in the case of low pressure engines. The rate of boil off, however, typically exceeds the rate of demand for the compressed natural gas. The excess natural gas is thus liquefied in the heat exchanger 50 and is returned to the battery 2 of the storage tanks 4, 6, 8, 10 and 12. There is thus avoided any need wastefully to burn in a gas combustion unit (GCU) the excess natural gas. If desired, during the return voyage, the refrigeration cycle may not be operated and there is thus no reliquefaction of any of the boiled off natural gas. Further, on a return voyage, the temperature of the natural gas in the pipeline 20 tends to be much higher than when the tanks 4, 6, 8, 10 and 12 are fully laden with LNG. The inlet temperature is typically common in these circumstances, above −50° C. By appropriate setting of the flow control valves 44 and 62 the temperature of the natural gas entering the compressor 24 can be set to the same preselected value as during the laden voyage.

In normal laden operation, the cooling of the compressed natural gas in the heat exchanger 22 reduces the amount of work that needs to be done by the refrigeration cycle 50 in liquefying the natural gas. The method and apparatus according to the invention therefore make it possible to keep down the overall power consumption of the compression-liquefaction systems shown in the drawings.

The invention claimed is:

1. A method of recovering boil off gas evolved from at least one storage vessel (4,6,8,10,12) holding liquefied natural gas (LNG), comprising:

cold compressing a flow of the boil off gas in a first compression stage (26), warming by heat exchange in a heat exchanger (22) the flow of the cold compressed boil off gas, further compressing the warmed flow of the cold compressed boil off gas, and employing at least part of the further compressed flow of the boil off gas to warm in the heat exchanger the flow of the cold compressed boil off gas and thereby reducing a temperature of the at least part of the further compressed boil off gas, and reliquefying at least a portion of the part of the further compressed flow of the boil off gas, reliquefying in a liquefier (47) at least a portion of the part of the further compressed flow of the boil off gas that is subjected to the reducing temperature, supplying a gas supply pipeline (40) with another part of the further compressed flow of the boil off gas, and controlling a proportion of the further compressed boil off gas that is subjected to the reducing temperature by actuating a first control valve (62) located in a conduit (64) branching off a pipeline (42), the pipeline going from the heat exchanger (22) to the liquefier (47), and the conduit (64) terminating in the gas supply pipeline (40) for an engine, and by actuating a second control valve (44) positioned in the gas supply pipeline (40) upstream of a union of the gas supply pipeline with the conduit (64).

2. The method according to claim 1, wherein refrigeration for the reliquefying is provided by a Brayton cycle.

3. The method according to claim 2, further comprising pre-cooling with the Brayton cycle for the further compressing flow of the boil off gas that is reliquefied.

4. The method according to claim 2, further comprising providing a high pressure stream of natural gas from the at least one LNG storage vessel for providing additional refrigeration for the reliquefying.

5. The method according to claim 1, comprising operating said method on board ship.

6. The method according to claim 1, wherein an outlet temperature of the first compression stage is less than −5° C.

7. An apparatus for recovering boil off gas from at least one storage vessel (4,6,8,10,12) holding liquefied natural gas, comprising:

a first cold compression stage (26) communicating with the at least one storage vessel;

a plurality of further compression stages (28,30,32) in series for further compressing the boil off gas downstream of the cold compression stage;

a gas supply pipeline (40) connected to the plurality of further compression stages;

a liquefier (47) downstream of the plurality of further compression stages for reliquefying the boil off gas;

a heat exchanger (22) having at least one first heat exchange passage having an inlet communicating with an outlet of the first cold compression stage and another outlet communicating with the plurality of further compression stages, and at least one second heat exchange passage in heat exchange relationship with the at least one first heat exchange passage, the at least one second heat exchange passage having an inlet in communication with the plurality of further compression stages and an outlet in communication with the liquefier;

a pipeline (42) from the heat exchanger (22) to the liquefier (47), the pipeline comprising a first control valve (62) located in a conduit (64), the conduit branching off the pipeline (42) and going to the gas supply pipeline (40) for an engine, and a second control valve (44) positioned in the gas supply pipeline upstream of a union of the gas supply pipeline (40) with the conduit (64).

8. The apparatus according to claim 7, wherein the liquefier is operable on a Brayton cycle.

9. The apparatus according to claim 7, wherein the apparatus is onboard a sea-going vessel.

* * * * *